US008982526B2

(12) United States Patent
Anjiki et al.

(10) Patent No.: US 8,982,526 B2
(45) Date of Patent: Mar. 17, 2015

(54) POLYMER SURGE ARRESTER

(71) Applicant: Kabushiki Kaisha Toshiba, Tokyo (JP)

(72) Inventors: Tomikazu Anjiki, Yokohama (JP); Katsuaki Komatsu, Yokohama (JP); Yoshiaki Aka, Kawasaki (JP); Jun Kobayashi, Yokohama (JP); Takamichi Tsukui, Kawasaki (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 71 days.

(21) Appl. No.: 13/771,581

(22) Filed: Feb. 20, 2013

(65) Prior Publication Data

US 2013/0279059 A1 Oct. 24, 2013

(30) Foreign Application Priority Data

Apr. 24, 2012 (JP) ..... 2012-098590

(51) Int. Cl.
*H01C 7/12* (2006.01)
*H01C 7/10* (2006.01)

(52) U.S. Cl.
CPC ..... *H01C 7/12* (2013.01); *H01C 7/126* (2013.01); *H01C 7/10* (2013.01)
USPC ..... 361/127; 361/126

(58) Field of Classification Search
CPC ..... H01C 7/10; H01C 7/12; H01C 7/126
USPC ..... 361/127, 126
See application file for complete search history.

(56) References Cited

U.S. PATENT DOCUMENTS

| | | | | |
|---|---|---|---|---|
| 4,265,460 | A * | 5/1981 | Senzaki | 279/97 |
| 6,835,196 | B2 * | 12/2004 | Biedermann et al. | 606/308 |
| 7,223,298 | B2 * | 5/2007 | Platt et al. | 95/286 |
| 8,446,703 | B2 * | 5/2013 | Klaube et al. | 361/117 |

FOREIGN PATENT DOCUMENTS

JP 2002-151309 5/2002

* cited by examiner

*Primary Examiner* — Zeev V Kitov
(74) *Attorney, Agent, or Firm* — Oblon, McClelland, Maier & Neustadt, L.L.P.

(57) ABSTRACT

A plurality of insulating rods are placed at peripheries of the nonlinear resistor and the metal plates, and each having an upper end portion and a lower end portion inserted into holes formed in the electrodes. A spacer is placed between an inner peripheral surface of the hole and an outer peripheral surface of the insulating rod inside the hole of the electrode, and a fixing screw is attached to the hole of the electrode. A double-ended bolt couples the metal plate and the electrode together. The double-ended bolt has a first screw part and a second screw part opposite in a fastening direction to the first screw part which are provided on a same axis. The first screw part is attached to the metal plate, and the second screw part is attached to the electrode.

5 Claims, 11 Drawing Sheets

FIG.11

| COMPARATIVE EXAMPLE | EMBODIMENT | |
|---|---|---|
| | TIGHTENING TORQUE OF FIXING SCREW IN CASE OF 45N·m | TIGHTENING TORQUE OF FIXING SCREW IN CASE OF 110N·m |
| 400N·m | 1600N·m | 3400N·m |

POLYMER SURGE ARRESTER

CROSS-REFERENCE TO RELATED APPLICATION

This application is based upon and claims the benefit of priority from the prior Japanese Patent Application No. 2012-098590, filed on Apr. 24, 2012; the entire contents of which are incorporated herein by reference.

FIELD

Embodiments described herein relate generally to a polymer surge arrester.

BACKGROUND

In a power system, a surge arrester is provided to protect facilities from abnormal voltage (surge) due to thunderbolt. The surge arrester has a nonlinear resistor, for example, containing zinc oxide as a main component. The nonlinear resistor is insulative when normal voltage acts, and becomes conductive by decreasing in resistance value when abnormal voltage acts.

Among surge arresters, a polymer surge arrester is configured such that an electrode is placed at each of an upper end and a lower end of a stack made by stacking a plurality of nonlinear resistors and a plurality of insulating rods are arranged side by side around the outer peripheral surface of the nonlinear resistors. Further, in the polymer surge arrester, an outer skin made of insulating resin covers the outer peripheral surface of the stack of the nonlinear resistors around which the insulating rods are arranged. The insulating rod is formed using, for example, FRP (Fiber Reinforced Plastics), and the outer skin is formed using, for example, silicone rubber.

Since the polymer surge arrester is lower in mechanical strength than an insulator surge arrester housing the nonlinear resistors in a porcelain container and therefore needs to be improved in mechanical strength.

The polymer surge arrester has the outer skin formed of an insulating resin with low mechanical strength. Therefore, the polymer surge arrester needs to secure the mechanical strength of the whole polymer surge arrester by the insulating rods and the nonlinear resistors higher in mechanical strength than the outer skin.

However, it is sometimes not easy to sufficiently improve the mechanical strength in the polymer surge arrester. For example, when fastening is realized by attaching a male screw part provided at the insulating rod to a female screw part of the electrode, the male screw part provided at the insulating rod may break when a bending stress is applied to the polymer surge arrester. Further, the fastening may be loosened because thermal processing is performed when forming the outer skin is formed by molding the insulating resin.

BRIEF DESCRIPTION OF THE DRAWINGS

FIG. 11 is a chart presenting the result of a bending test in the polymer surge arrester according to the embodiment.

DETAILED DESCRIPTION

A polymer surge arrester of this embodiment has metal plates placed at an upper end face and a lower end face of a nonlinear resistor. Electrodes are place on the upper end face and the lower end face of the nonlinear resistor via the metal plates. A plurality of insulating rods are placed at side surfaces of the nonlinear resistor and the metal plates, and an upper end portion and a lower end portion of each of the insulating rods are inserted into holes formed in the electrodes. A spacer is inserted between an inner peripheral surface of the hole and an outer peripheral surface of the insulating rod inside the hole of the electrode, and a fixing screw is attached to the hole of the electrode. A double-ended bolt couples the metal plate and the electrode together. The double-ended bolt has a first screw part and a second screw part opposite in a fastening direction to the first screw part which are provided on a same axis. The first screw part is attached to the metal plate, and the second screw part is attached to the electrode.

Embodiments will be described with reference to the drawings.

[A] Configuration

Figure 1:
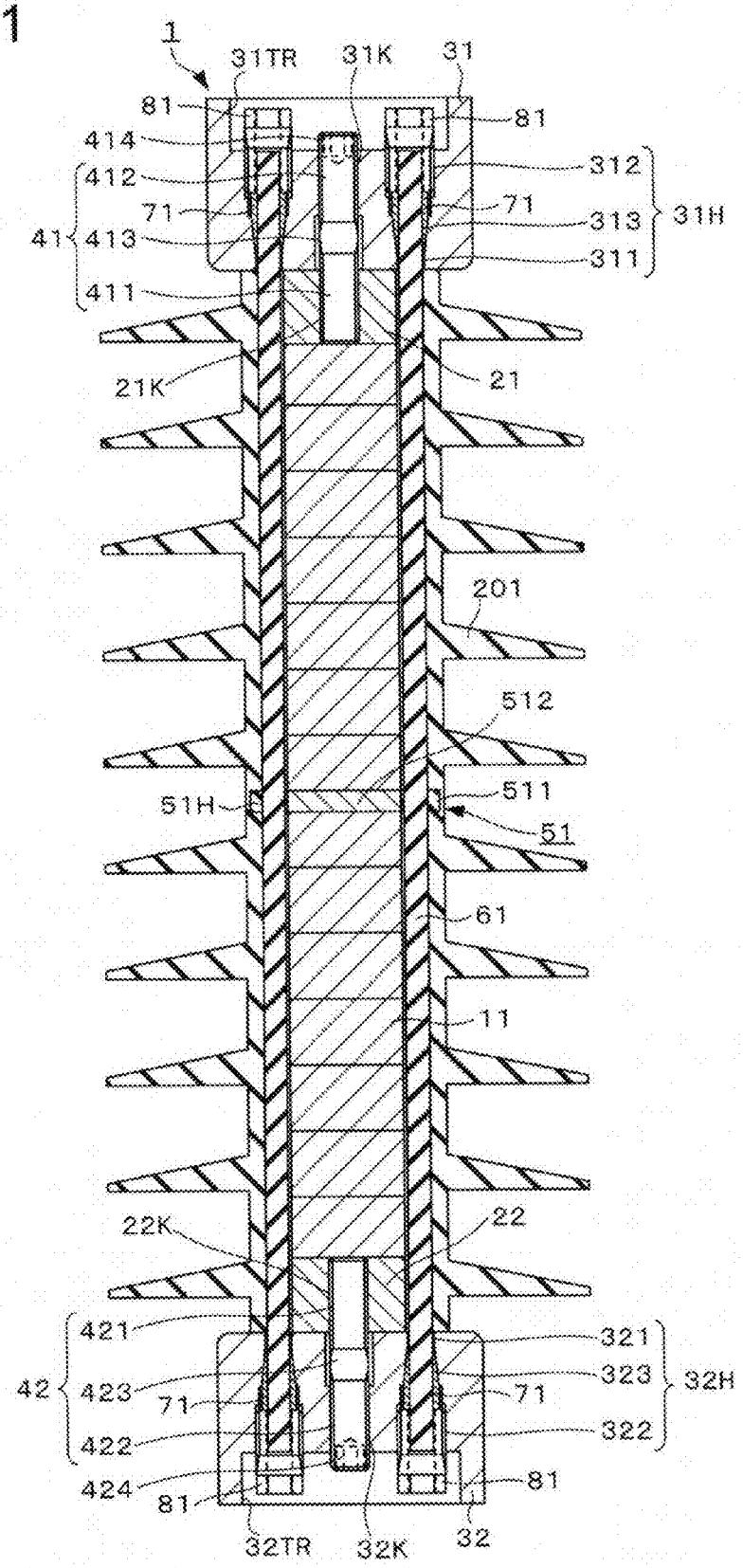
FIG. 1 is a sectional view illustrating the whole polymer surge arrester according to an embodiment.

FIG. 1 is a sectional view illustrating the whole polymer surge arrester according to an embodiment.

As illustrated in FIG. 1, a polymer surge arrester 1 has nonlinear resistors 11, metal plates 21, 22, electrodes 31, 32, double-ended bolts 41, 42, a fixed plate 51, insulating rods 61, spacers 71, fixing screws 81, and an outer skin 201.

Figure 2A:
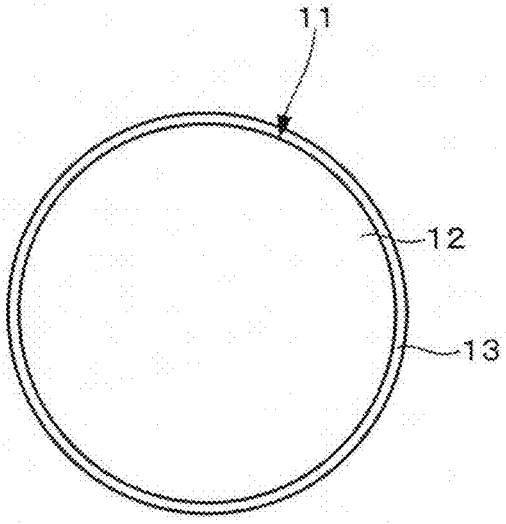
FIGS. 2A and 2B are views illustrating a nonlinear resistor in the polymer surge arrester according to the embodiment.
Figure 5A:
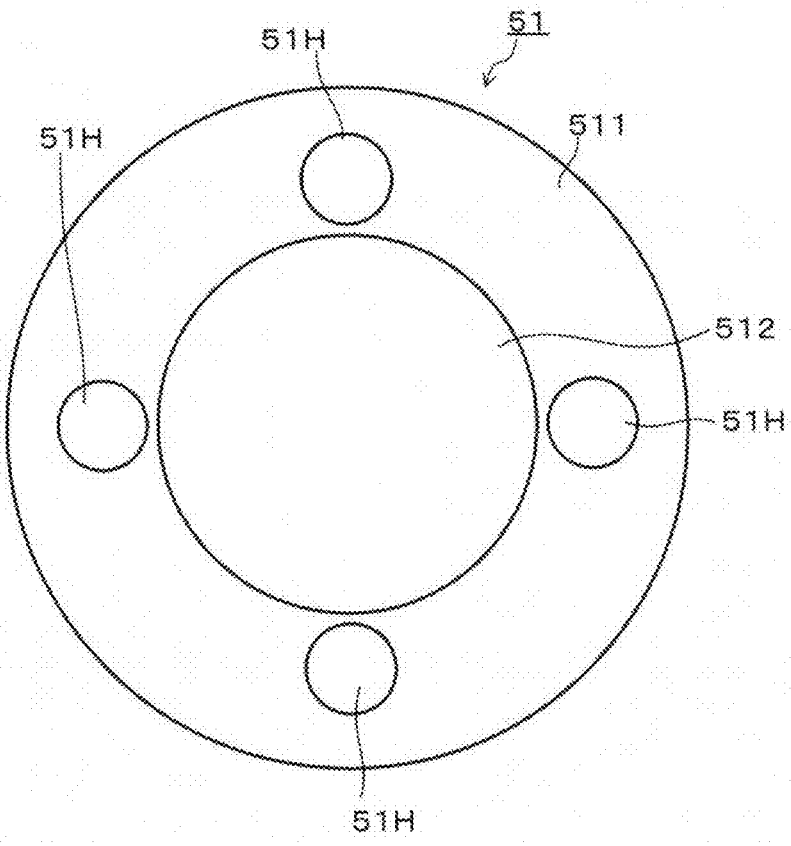
FIGS. 5A and 5B are views illustrating a fixed plate in the polymer surge arrester according to the embodiment.
Figure 5B:
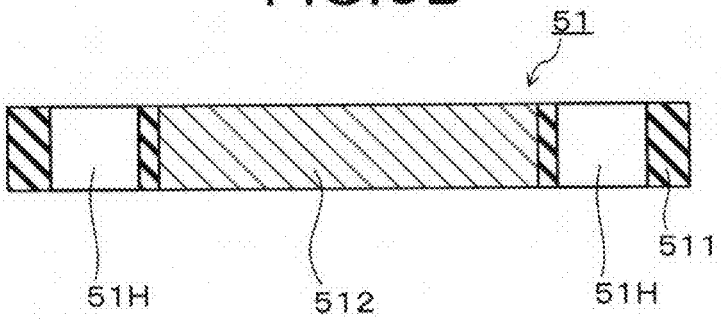
Figure 6A:
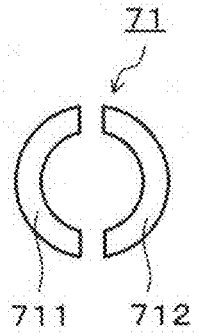
FIGS. 6A and 6B are views illustrating a spacer in the polymer surge arrester according to the embodiment.
Figure 6B:
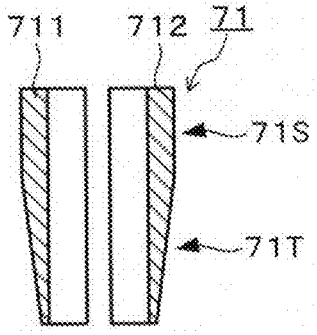
Figure 7:
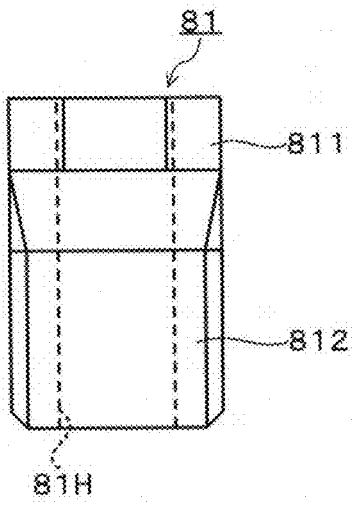
FIG. 7 is a view illustrating a fixing screw in the polymer surge arrester according to the embodiment.

FIG. 2A to FIG. 7 are views illustrating parts constituting the polymer surge arrester according to this embodiment. FIGS. 2A and 2B illustrate the nonlinear resistor 11, FIGS. 3A and 3B illustrate the metal plate 21, FIGS. 4A and 4B illustrate the electrode 31, FIGS. 5A and 5B illustrate the fixed plate 51, FIGS. 6A and 6B illustrate the spacer 71, and FIG. 7 illustrates the fixing screw 81. FIG. 2A to FIG. 6A illustrate enlarged upper surfaces, and FIG. 2B to FIG. 6B illustrate enlarged lateral cross-sections. Further, FIG. 7 illustrates an enlarged side surface of the fixing screw 81.

The parts constituting the polymer surge arrester 1 will be described below in order using FIG. 2A to FIG. 7 together with FIG. 1.

[A-1] Regarding the Nonlinear Resistor 11

Figure 2B:
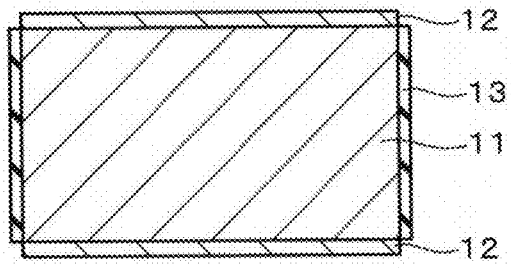

A plurality of the nonlinear resistors 11 are stacked as illustrated in FIG. 1. One nonlinear resistor 11 is a disc-shaped sintered compact part containing zinc oxide as a main component as illustrated in FIG. 2A, FIG. 2B, and electrode parts 12 made of metal such as aluminum are provided on upper and lower flat surfaces of the nonlinear resistor 11 and an insulating layer 13 is provided on the side surface (cylindrical surface) thereof. The nonlinear resistor 11 is insulative when normal voltage acts, and becomes conductive by decreasing in resistance value when abnormal voltage higher than the normal voltage acts.

[A-2] Regarding the Metal Plates 21, 22

The metal plates 21, 22 are placed respectively on the upper end face and the lower end face of a stack made by stacking the plurality of nonlinear resistors 11 as illustrated in FIG. 1. The metal plate 21, 22 has the same outer diameter as that of the nonlinear resistor 11.

Figure 3A:
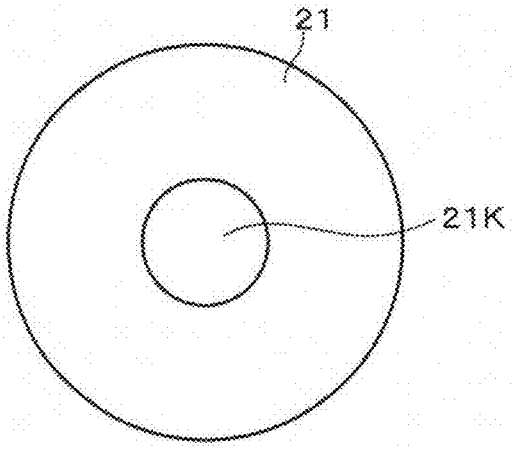
FIGS. 3A and 3B are views illustrating a metal plate in the polymer surge arrester according to the embodiment.
Figure 3B:
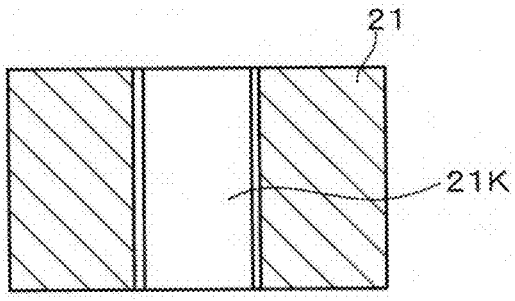

The one metal plate 21 of the pair of metal plates 21, 22 which is placed on the upper end face is cylindrical and provided with an opening 21K at its center as illustrated in FIG. 3A, FIG. 3B.

As illustrated in FIG. 1, the opening 21K of the metal plate 21 passes in the stacking direction of the nonlinear resistors 11. In addition, the opening 21K of the metal plate 21 is formed with a female screw, on the inner peripheral surface, to which a male screw of a left screw part 411 of the later-described double-ended bolt 41 is screwed.

Though the enlarged view is omitted, the other metal plate 22 placed on the lower end face is formed similarly to the one metal plate 21 placed on the upper end face. More specifically, the other metal plate 22 placed on the lower end face is cylindrical and provided with an opening 22K at its center. The opening 22K of the metal plate 22 is formed with a female screw, on the inner peripheral surface, to which a male screw of a left screw part 421 of the double-ended bolt 42 is screwed as illustrated in FIG. 1.

[A-3] Regarding the Electrodes 31, 32

The electrodes 31, 32 are placed on the upper end face and the lower end face of the stack made by stacking the plurality of nonlinear resistors 11 via the metal plates 21, 22 respectively as illustrated in FIG. 1. The electrode 31, 32 has an outer diameter larger than that of the nonlinear resistor 11, and has a recessed part 31TR, 32TR formed in the other surface located on the opposite side to one surface in contact with the metal plate 21, 22.

Figure 4A:
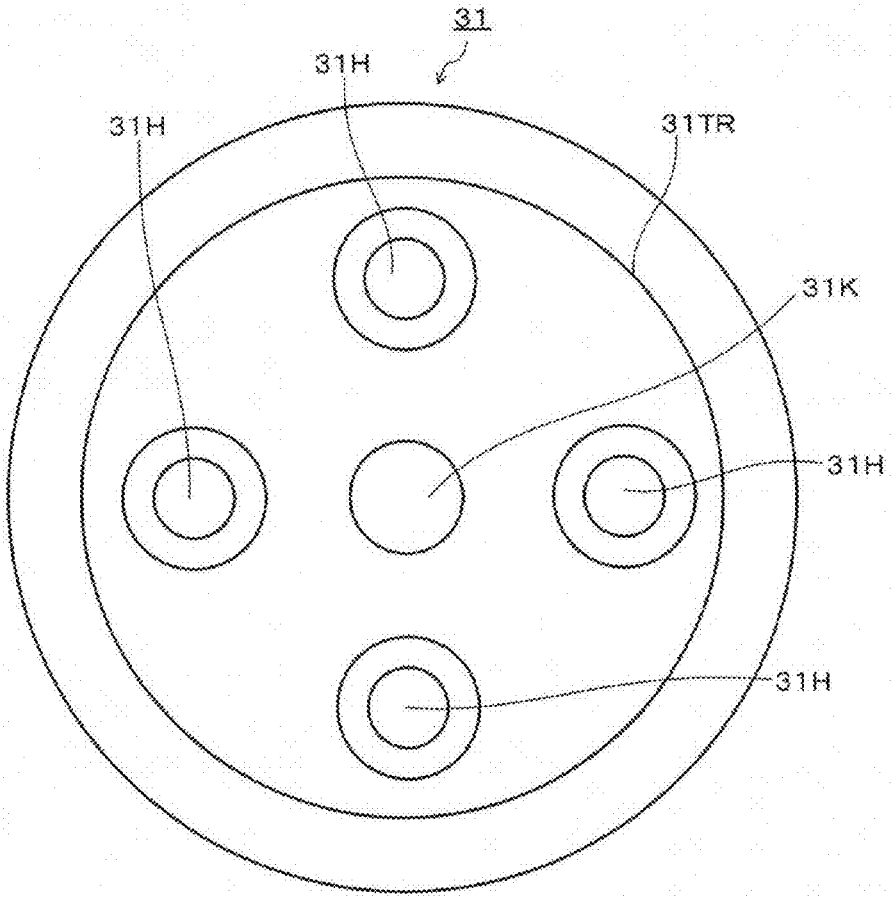
FIGS. 4A and 4B are views illustrating an electrode in the polymer surge arrester according to the embodiment.
Figure 4B:
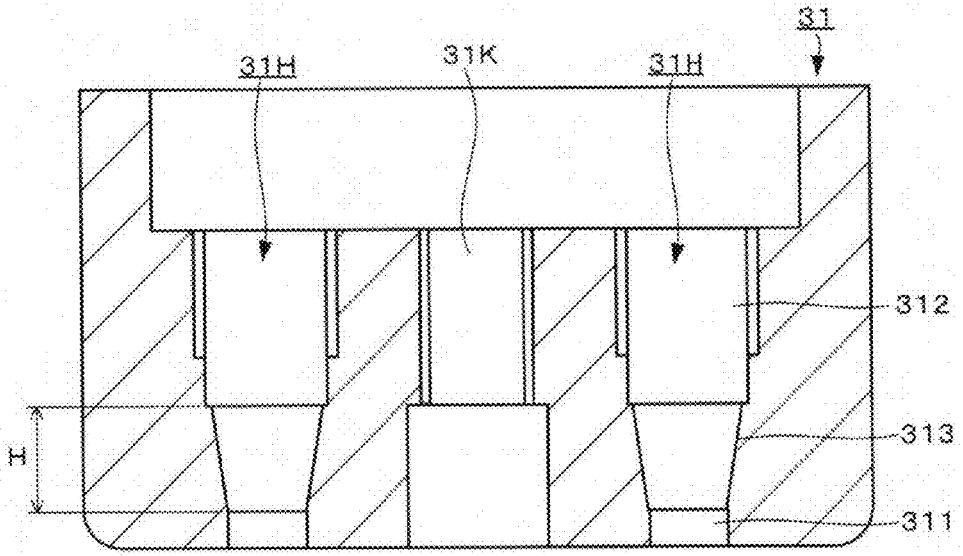

The one electrode 31 of the pair of electrodes 31, 32 which is placed on the upper end face is cylindrical as illustrated in FIG. 4A, FIG. 4B. The electrode 31 has an opening 31K at the center of the recessed part 31TR. In addition, a plurality of holes 31H are arranged at regular intervals around the opening 31K provided at the center in the recessed part 31TR of the electrode 31.

As illustrated in FIG. 1, the opening 31K provided at the center of the electrode 31 passes in the stacking direction of the nonlinear resistors 11. In addition, to the opening 31K, a right screw part 412 of the double-ended bolt 41 is attached. More specifically, the opening 31K is formed with a female screw on the inner peripheral surface on the side of the surface in which the recessed part 31TR is formed in the electrode 31 as illustrated in FIG. 4B, and a male screw of the right screw part 412 of the later-described double-ended bolt 41 is screwed to the female screw.

The plurality of holes 31 provided at the periphery in the electrode 31 pass in the stacking direction of the nonlinear resistors 11 as illustrated in FIG. 1. After the insulating rod 61 is inserted into the hole 31H and the spacer 71 is inserted to the outer periphery of the insulating rod 61 therein, the fixing screw 81 is attached to the outer periphery of the insulating rod 61.

Specifically, the hole 31H provided at the periphery in the electrode 31 has a first cylindrical part 311, a second cylindrical part 312 (cylindrical part), and a tapered part 313 as illustrated in FIG. 4B.

The first cylindrical part 311 is formed on the side of the surface opposite to the surface in which the recessed part 31TR is formed in the electrode 31 as illustrated in FIG. 4B.

The second cylindrical part 312 has an inner diameter larger than that of the first cylindrical part 311, on the side of the surface in which the recessed part 31TR is formed in the electrode 31 as illustrated in FIG. 4B. The second cylindrical part 312 is formed with a female screw, on the inner peripheral surface, to which a male screw of the fixing screw 81 is screwed in a state that the insulating rod 61 is inserted therein as illustrated in FIG. 1.

The tapered part 313 is formed between the first cylindrical part 311 and the second cylindrical part 312 as illustrated in FIG. 4B. The tapered part 313 is conical and formed to have an inner diameter increasing from the side of the first cylindrical part 311 to the side of the second cylindrical part 312. Specifically, in the tapered part 313, an inner diameter on the first cylindrical part 311 side is substantially the same as that of the first cylindrical part 311 and an inner diameter on the second cylindrical part 312 side is smaller than that of the second cylindrical part 312. The tapered part 313 is formed such that, for example, a height H is 15 mm or more. Further, as illustrated in FIG. 1, the spacer 71 is fitted into the tapered part 313 with the insulating rod 61 being inserted therein.

Though the enlarged view is omitted, the other electrode 32 placed on the lower end face is formed similarly to the one electrode 31 placed on the upper end face. In other words, the electrode 32 has the opening 32K at the center of the recessed part 32TR. In addition, a plurality of holes 32H are arranged at regular intervals around the opening 32K provided at the center in the recessed part 32TR of the electrode 32. Further, each of the plurality holes 32H has a first cylindrical part 321, a second cylindrical part 322, and a tapered part 323.

[A-4] Regarding the Double-Ended Bolts 41, 42

The double-ended bolts 41, 42 fasten both the metal plates 21, 22 and the electrodes 31, 32 as illustrated in FIG. 1.

The double-ended bolts 41, 42 have left screw parts 411, 421 (first screw parts), right screw parts 412, 422 (second screw parts), and middle parts 413, 423. In the double-ended bolt 41, 42, the left screw part 411, 421 and the right screw part 412, 422 are arranged on the same axis via the middle part 413, 423 along the stacking direction of the nonlinear resistors 11.

The left screw parts 411, 421 are attached inside the openings 21K, 22K provided at the centers of the metal plates 21, 22. The left screwparts 411, 421 are rotated in the counterclockwise direction to move to the back (in the direction of the nonlinear resistor 11 in FIG. 1) inside the openings 21K, 22K.

The right screw parts 412, 422 are attached inside the openings 31K, 32K provided at the centers of the electrodes 31, 32. The right screw parts 412, 422 are rotated in a direction opposite to that of the left screw parts 411, 421, that is, the clockwise direction to move to the back (in the direction of the nonlinear resistor 11 in FIG. 1) inside the openings 31K, 32K.

Other than the above, the double-ended bolts 41, 42 are provided with fasten holes 414, 424 in top surfaces on the sides on which the right screw parts 412, 422 are provided. The fasten holes 414, 424 are, for example, hexagon holes into which a tool such as a hexagonal wrench is inserted when the double-ended bolts 41, 42 are rotated to adjust the fastening between the metal plates 21, 22 and the electrodes 31, 32.

[A-5] Regarding the Fixed Plate 51

The fixed plate 51 is interposed at a predetermined position of the stack of the nonlinear resistors 11 as illustrated in FIG. 1. The fixed plate 51 here is placed near the center in the stacking direction of the stack of the nonlinear resistors 11 as an example.

As illustrated in FIG. 5A, FIG. 5B, the fixed plate 51 has an insulating part 511 and a conductive part 512.

The insulating part 511 is in a ring shape as illustrated in FIG. 5A, FIG. 5B. The conductive part 512 is in a disc shape and provided at an inner peripheral portion of the insulating part 511.

As illustrates in FIG. 1, the insulating part 511 has an outer diameter larger than that of the nonlinear resistor 11, and the conductive part 512 has an outer diameter substantially the same as that of the nonlinear resistor 11. The conductive part 512 is sandwiched between the nonlinear resistors 11 to electrically connect the plurality of nonlinear resistors 11.

As illustrated in FIG. 5A, FIG. 5B, in the insulating part 511, a plurality of holes 51H are arranged at regular intervals around the conductive part 512. The plurality of holes 51H pass in the stacking direction of the nonlinear resistors 11 as illustrated in FIG. 1, into which the insulating rods 61 are inserted. Each of the plurality of holes 51H has an outer diameter substantially the same as that of the insulating rod 61.

[A-6] Regarding the Insulating Rod 61

The insulating rod 61 is in a rod-shaped body and is disposed along the stacking direction of the nonlinear resistors 11 as illustrated in FIG. 1. The insulating rod 61 has a diameter of, for example, 10 mm or more, and is formed of FRP.

The insulating rod 61 is placed on the side surfaces (outer peripheral surfaces) of the nonlinear resistors 11 and the metal plates 21, 22. The insulating rod 61 has an upper end portion and a lower end portion inserted into the holes 31H, 32H provided in the electrodes 31, 32. In addition, the insulating rod 61 is inserted into the hole 51H provided at the periphery of the fixed plate 51. As is clear from FIG. 1, a predetermined number of insulating rods 61 are arranged at regular intervals around the outer peripheral surfaces of the stack of the nonlinear resistors 11 and the metal plates 21, 22.

[A-7] Regarding the Spacer 71

The spacers 71 are placed inside the holes 31H, 32H provided at the periphery of the electrodes 31, 32 as illustrated in FIG. 1. The spacer 71 here intervenes between the inner peripheral surface of the tapered part 313, 323 and the outer peripheral surface of the insulating rod 61 inside the hole 31H, 32H.

As illustrated in FIG. 6A, FIG. 6B, the spacer 71 has a first spacer part 711 and a second spacer part 712. When the first spacer part 711 and the second spacer part 712 are combined together, a tubular body is formed. The tubular body made by combining the first spacer part 711 and the second spacer part 712 together is provided with a tapered part 71T on one end of a cylindrical part 71S. The tapered part 71T is conical and has an outer diameter on the cylindrical part 71S side that is the same as that of the cylindrical part 71S and becomes smaller as it is separated more from the cylindrical part 71S.

In other words, each of the first spacer part 711 and the second spacer part 712 has a cross-section of the tapered part 71T in a wedge shape, and has a thickness on the cylindrical part 71S side that is the same as that of the cylindrical part 71S and becomes smaller as it is separated more from the cylindrical part 71S.

[A-8] Regarding the Fixing Screw 81

The fixing screw 81 is placed inside the hole 31H, 32H provided at the periphery of the opening 31K, 32K in the electrode 31, 32 as illustrated in FIG. 1. The fixing screw 81 has a through hole 81H formed therein, and the insulating rod 61 is inserted into the through hole 81H therein.

As illustrated in FIG. 7, the fixing screw 81 has a head part 811 and a screw part 812. In the fixing screw 81, the head part 811 is, for example, in a regular hexagonal column shape (bolt shape) and fastened by a fastening tool placed thereon. The screw part 812 has a male screw formed on the outer peripheral surface and attached to the second cylindrical part 312 of the hole 31H provided in the electrode 31.

Though details will be described later, the fixing screw 81 pushes the spacer 71 with a predetermined tightening torque inside the hole 31H, 32H of the electrode 31, 32 to fix the insulating rod 61 to the electrode 31, 32.

[A-9] Regarding the Outer Skin 201

The outer skin 201 covers the outer peripheral surface of the stack of the nonlinear resistors 11 for which the insulating rods 61 are disposed as illustrated in FIG. 1. The outer skin 201 is formed by molding an insulating resin such as a silicone rubber.

[B] Manufacturing Method

Figure 8:
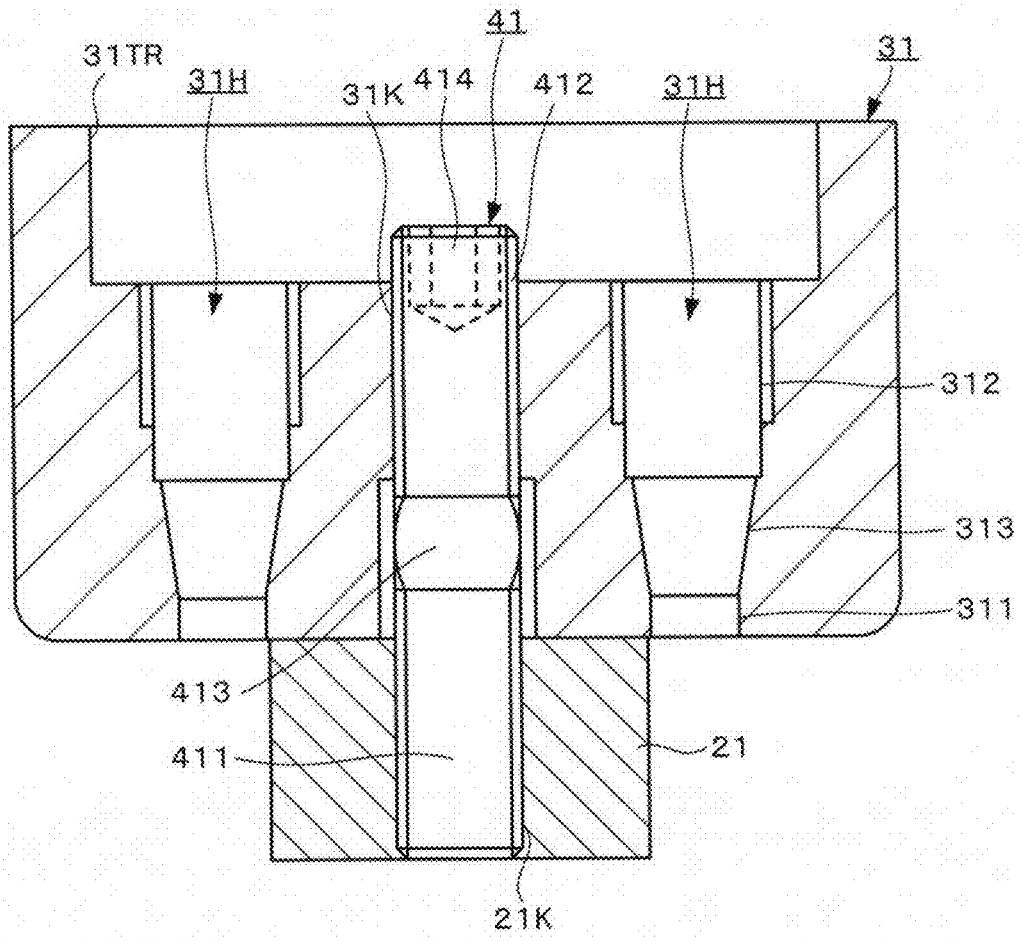
FIG. 8 is a sectional view illustrating a manufacturing method of the polymer surge arrester according to an embodiment.
Figure 9:
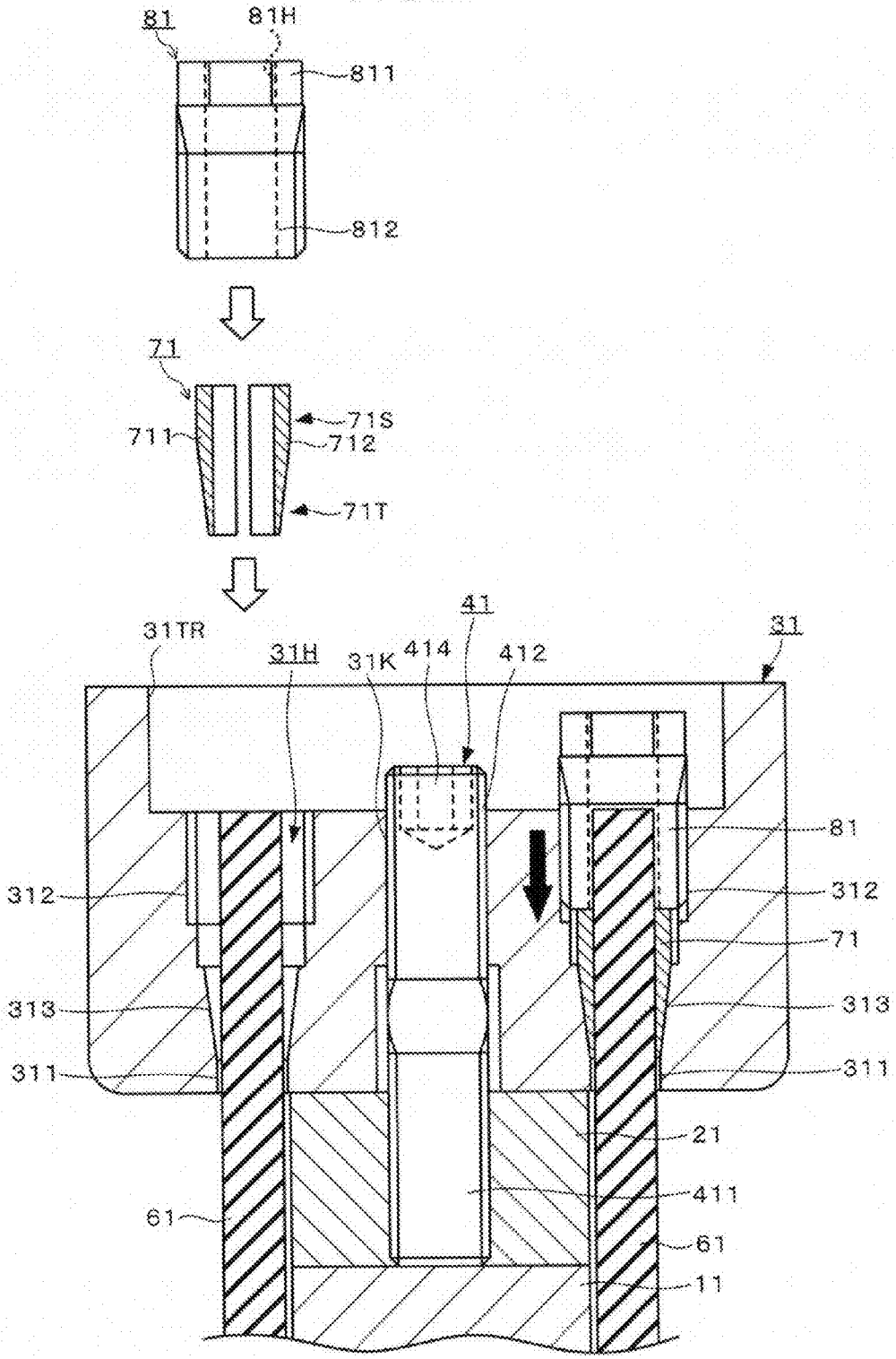
FIG. 9 is a sectional view illustrating the manufacturing method of the polymer surge arrester according to the embodiment.
Figure 10:
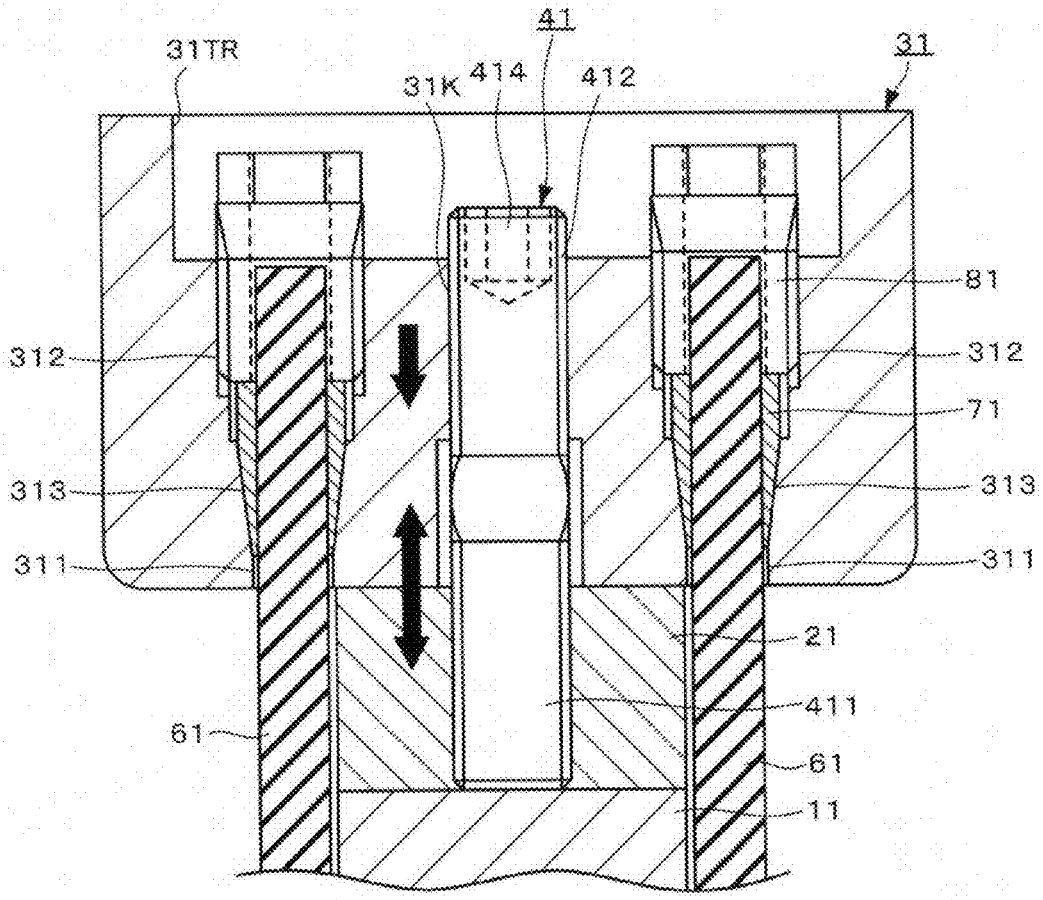
FIG. 10 is a sectional view illustrating the manufacturing method of the polymer surge arrester according to the embodiment.

FIG. 8 to FIG. 10 are sectional views illustrating a manufacturing method of the polymer surge arrester according to an embodiment.

When manufacturing the above-described polymer surge arrester 1, both of the metal plate 21 and the electrode 31 are combined together first with the double-ended bolt 41 as illustrated in FIG. 8.

Specifically, the right screw part 412 of the double-ended bolt 41 is screwed into the opening 31K provided at the center of the electrode 31, whereby the double-ended bolt 41 is attached to the electrode 31. Then, the left screw part 411 of the double-ended bolt 41 is screwed into the opening 21K of the metal plate 21, whereby the double-ended bolt 41 is attached to the metal plate 21. In this manner, a combined body of the metal plate 21 and the electrode 31 is formed.

Though the combined body of the metal plate 21 and the electrode 31 which is placed on the upper end side in the polymer surge arrester 1 as illustrated in FIG. 1 is illustrated in FIG. 8, a combined body of the metal plate 22 and the electrode 32 which is placed on the lower end side is assembled similarly to the above.

Then, the plurality of insulating rods 61 are attached to the combined body of the metal plate 22 and the electrode 32 which is placed on the lower end side as illustrated in FIG. 1. Then, in a space surrounded by the plurality of insulating rods 61, the plurality of the nonlinear resistors 11 are stacked. In this event, the fixed plate 51 is appropriately interposed between the plurality of nonlinear resistors 11. Then, the combined body of the metal plate 21 and the electrode 31 which is to be placed on the upper end side is attached to the plurality of insulating rods 61.

As illustrated in FIG. 9, when attaching the combined body of the metal plate 21 and the electrode 31 to the plurality of insulating rods 61, the spacers 71 and the fixing screws 81 are used.

Specifically, the spacer 71 is inserted into the hole 31H of the electrode 31 into which the insulating rod 61 has been inserted as illustrated in FIG. 9. Here, the spacer 71 is inserted from the side of the surface in which the second cylindrical part 312 is provided in the hole 31H of the electrode 31, whereby the tapered part 71T of the spacer 71 is interposed between the inner peripheral surface of the tapered part 313 of the hole 31H and the outer peripheral surface of the insulating rod 61.

Thereafter, as illustrated in FIG. 9, the fixing screw 81 is attached inside the hole 31H of the electrode 31. Here, the fixing screw 81 is screwed from the side of the surface in which the second cylindrical part 312 is provided in the hole 31H of the electrode 31 to attach the fixing screw 81 to the electrode 31.

When attaching, the fixing screw 81 advances to the side (a black arrow in FIG. 9) of the tapered part 313 of the hole 31H formed in the electrode 31 in the state that the insulating rod 61 is inserted in the through hole 81H formed therein. Then, the fixing screw 81 pushes the spacer 71 placed at the tapered part 313 of the hole 31H with a predetermined tightening torque. Thus the tapered part 71T of the spacer 71 is pushed into the tapered part 313 of the hole 31H, so that the spacer 71 compresses and tightens the insulating rod 61 from the periphery. Along with this, a tensile load is applied on the insulating rod 61 in its axial direction. Therefore, the electrode 31 and the insulating rod 61 are strongly fixed by the frictional force with respect to the spacer 71.

Though illustration is omitted, the plurality of insulating rods 61 are attached to the combined body of the metal plate 22 and the electrode 32 which is placed on the lower end side by the method similar to the above.

Then, the double-ended bolt 41 is tightened (a downward arrow in FIG. 10) as illustrated in FIG. 10.

As described above, both of the metal plate 21 and the electrode 31 are coupled together by the double-ended bolt 41. The left screw part 411 of the double-ended bolt 41 is attached to the metal plate 21. In contrast to this, the right screw part 412 of the double-ended bolt 41 is attached to the electrode 31.

Therefore, by inserting the fastening tool into the fasten hole 414 provided in the double-ended bolt 41 and tightening the double-ended bolt 41 (rotating the right screw part 412 in the clockwise direction), the metal plate 21 and the electrode 31 move in directions (both arrows in FIG. 10) in which they are separated from each other in the axial direction of the double-ended bolt 41. As a result of this, a compressive load is applied on the plurality of nonlinear resistors 11 in the axial direction of the double-ended bolt 41 (the stacking direction), and a tensile load is applied on the insulating rods 61 in the axial direction. Therefore, the stack of the electrode 31, the metal plate 21, the insulating rods 61 and the plurality of nonlinear resistors 11 is strongly fixed in the stacking direction (the axial direction of the polymer surge arrester).

Though illustration is omitted, for the combined body of the metal plate 22 and the electrode 32 which is placed on the lower end side, the double-ended bolt 42 is also tightened by the method similar to the above.

Then, as illustrated in FIG. 1, the outer peripheral surface of the stack of the nonlinear resistors 11 in which the insulating rods 61 are disposed is covered with the outer skin 201. Here, the outer skin 201 is provided by molding an insulating resin such as a silicone rubber.

By providing the parts as described above, the polymer surge arrester 1 is completed.

[C] Bending Test Result

FIG. 11 is a chart presenting the result of the bending test in the polymer surge arrester according to the embodiment. FIG. 11 presents the result of a bending fracture value of an internal element provided inside the outer skin 201 in the polymer surge arrester 1. Further, a case of a polymer surge arrester in which a male part provided in the insulating rod is attached and fastened to a female part of the electrode is taken as a comparative example.

The bending test was carried out by the following test method. First, (the internal element of) the surge arrester being a device under test was horizontally placed and its one end was strongly supported. Thereafter, force was applied to the other end at a certain rate in its vertical direction. Concurrently therewith, the internal element of the surge arrester was observed, and the force when abnormality such as crack or the like was recognized in any portion thereof was regarded as the fracture value.

As illustrated in FIG. 11, this embodiment is larger in the bending fracture value than the comparative example. Specifically, the bending fracture value in this embodiment when the tightening torque of the fixing screw 81 is 45 N·m is four times that of the comparative example, and the bending fracture value in this embodiment when the tightening torque of the fixing screw 81 is 110 N·m is much larger than that of comparative example.

In observation of the appearance of the fracture, when the tightening torque of the fixing screw 81 was 45 N·m, slippage occurred in the insulating rod 61 due to the bending load. On the other hand, when the tightening torque of the fixing screw 81 was 110 N·m, the insulating rod 61 was in the state that fibers of FRP were separated from each other. It was found from the result that the fibers of FRP were hard to fracture because the male part as in the comparative example was not formed in the insulating rod 61 in this embodiment, and that sufficient bending strength was able to be secured by the tensile force of the insulating rod 61.

Further, since the plurality of insulating rods 61 are strongly fixed to the electrode 31 in this embodiment, the tensile force or the compression force is applied on the plurality of insulating rods 61 when the bending load is applied. Therefore, the mechanical strength can be improved as the whole polymer surge arrester.

In addition to the above, the bending test was carried out for the case where the size of the double-ended bolt 41, 42 was M12 and M20. As a result, the displacement amount at application of the bending load in the case of M20 was ⅓ of that in the case of M12. Along with this, the strength of the internal element in the case of M20 was 1.5 times that in the case of the M12.

[D] Conclusion

As described above, the tapered parts 313, 323 are formed between the first cylindrical parts 311, 321 and the second cylindrical parts 312, 322 in the holes 31H, 32H of the electrode 31, 32 in this embodiment. The tapered part 313, 323 has an inner diameter smaller on the side of the nonlinear resistor 11 than on the side of the second cylindrical part 312, 322. The spacer 71 includes the tapered part 71T having an outer diameter smaller on the side of the nonlinear resistor 11 than on the second cylindrical part 312, 322, and the tapered part 71T of the spacer 71 is fitted into the tapered part 313, 323 of the hole 31H, 32H of the electrode 31, 32. The fixing screw 81 is attached to the cylindrical part 312, 322 of the hole 31H, 32H of the electrode 31, 32, and pushes the spacer 71 to the side of the nonlinear resistor 11 with the predetermined tightening torque inside the hole 31H, 32H of the electrode 31, 32. This causes the fixing screw 81 to fix the insulating rod 61 to the electrode 31, 32.

Therefore, the tapered part 71T of the spacer 71 is pushed into the tapered part 313 of the hole 31H in this embodiment, so that the spacer 71 can compress and tighten the insulating rod 61 from its periphery. Accordingly, the plurality of insulating rods 61 can be strongly fixed to the electrodes 31, 32 and therefore can improve the mechanical strength of the polymer surge arrester 1 in this embodiment.

Further, in this embodiment, the insulating rod 61 is not subjected to screw processing on the outer peripheral surface and does not have the male screw part as in the comparative example. Accordingly, fracture of the male screw part never occurs in the insulating rod 61 in this embodiment, and therefore the mechanical strength of the polymer surge arrester 1 can be improved by the tensile strength of the insulating rod 61.

In this embodiment, the metal plate 21, 22 and the electrode 31, 32 are coupled together by the double-ended bolt 41, 42.

In the double-ended bolt 41, 42, the left screw part 411, 421 (first screw part) and the right screw part (second screw part) opposite in the fastening direction to the left screw part 411, 421 are arranged on the same axis. The metal plate 21, 22 is provided with the opening 21K, 22K to which the left screw part 411, 421 is attached. In contrast, the electrode 31, 32 is provided with the opening 31K, 32K to which the right screw part 412, 422 is attached. Further, the double-ended bolt 41, 42 is provided with the fasten hole 414, 424 on the top surface on the side on which the right screw part 412, 422 is provided.

Therefore, the stack of the plurality of nonlinear resistors 11 can be strongly fixed in the stacking direction by the simple work of rotating the double-ended bolts 41, 42 as described above in this embodiment. In addition, the metal plates 21, 22 are coupled to the left screw parts 411, 421 of the double-ended bolts 41, 42 in this embodiment, so that when tightening the double-ended bolts 41, 42 after assembly, the rotation of the metal plates 21, 22 is suppressed by the friction with respect to the nonlinear resistors 11. As a result, it is possible to suppress twist of the internal elements provided inside the outer skin 201 to improve the mechanical strength of the polymer surge arrester 1. Further, by appropriately managing the tightening torque of the double-ended bolts 41, 42, it is possible to ensure sufficient conduction of the nonlinear resistors 11 and prevent poor contact so as to improve the reliability of the polymer surge arrester 1.

In this embodiment, the fixing screw 81 has the through hole 81H formed therein into which the insulating rod 61 is inserted. Therefore, the fixing screw 81 can uniformly push the spacer 71 to the side of the nonlinear resistor 11 in this embodiment. Accordingly, this embodiment can uniformly and strongly fix the insulating rods 61 to the electrodes 31, 32 and therefore can improve the mechanical strength of the polymer surge arrester 1.

[E] Modification Example

For the spacer 71 in the above embodiment, an asperity may be formed on the inner peripheral surface in contact with the outer peripheral surface of the insulating rod 61. It is preferable to form the asperity on the inner peripheral surface of the spacer 71, for example, by surface treatment such as the knurling or the sandblasting. By forming the asperity on the inner peripheral surface of the spacer 71, the frictional force with respect to the outer peripheral surface of the insulating rod 61 can be improved. As a result, the bending fracture value can be improved and the occurrence of displacement at application of the bending load can be suppressed, thus leading to further improvement in mechanical strength.

Note that though the case where the plurality of nonlinear resistors 11 are stacked has been described in this embodiment, the structure is not limited to this. For example, when one nonlinear resistor 11 is provided, the parts may be the structured as described above.

Though the holes 31H, 32H of the electrodes 31, 32 have the tapered parts 313, 323 formed between the first cylindrical parts 311, 321 and the second cylindrical parts 312, 322 in the above embodiment, the structure is not limited to the above. The first cylindrical parts 311, 321 do not always need to be formed.

Though the spacer 71 is composed of two parts that are the first spacer part 711 and the second spacer part 712 in the above embodiment, the structure is not limited to the above. The spacer 71 may be composed of three or more parts. Further, the spacer 71 is not composed of a plurality of parts but may be composed of one part.

While certain embodiments have been described, these embodiments have been presented by way of example only, and are not intended to limit the scope of the inventions. Indeed, the novel embodiments described herein may be embodied in a variety of the forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. A polymer surge arrester, comprising:

a nonlinear resistor;

metal plates placed on an upper end face and a lower end face of the nonlinear resistor;

electrodes placed on the upper end face and the lower end face of the nonlinear resistor via the metal plates;

a plurality of insulating rods placed at peripheries of the nonlinear resistor and the metal plates, and each having an upper end portion and a lower end portion inserted into holes formed in the electrodes;

a spacer inserted between an inner peripheral surface of the hole of the electrode and an outer peripheral surface of the insulating rod;

a fixing screw attached to the hole of the electrode; and a double-ended bolt coupling the metal plate and the electrode together, the double-ended bolt having a left screw part and a right screw part opposite in a fastening direction to the left screw part which are provided on a same axis, the left screw part being attached to the metal plate the right screw part being attached to the electrode, wherein, by rotating the right screw part in the clockwise direction, a compressive load is applied on the nonlinear resistor in the axial direction of the double-ended bolt and a tensile load is applied on the insulating rods in the axial direction.

2. The polymer surge arrester according to claim 1, wherein the hole of the electrode has a cylindrical part, and a tapered part located on a side closer to the nonlinear resistor than is the cylindrical part and having an inner diameter smaller on a side of the nonlinear resistor than on a side of the cylindrical part;

wherein the spacer includes a tapered part having an outer diameter smaller on the side of the nonlinear resistor than on the side of the cylindrical part, and the tapered part of the spacer is fitted in the tapered part of the hole; and wherein the fixing screw is attached to the cylindrical part of the hole and pushes the spacer to the side of the nonlinear resistor with a tightening torque to fix the insulating rod to the electrode.

3. The polymer surge arrester according to claim 1, wherein the double-ended bolt has a fasten hole formed in a top surface on a side where the right screw part is provided.

4. The polymer surge arrester according to claim 1, wherein the fixing screw has a through hole formed therein into which the insulating rod is inserted.

5. The polymer surge arrester according to claim 1, wherein the spacer has an asperity formed on a surface in contact with the outer peripheral surface of the insulating rod.

* * * * *